US010112359B2

(12) United States Patent
Messerschmid

(10) Patent No.: US 10,112,359 B2
(45) Date of Patent: Oct. 30, 2018

(54) METHOD AND DEVICE FOR MANUFACTURING A CUP

(71) Applicant: Uwe Messerschmid, Albershausen (DE)

(72) Inventor: Uwe Messerschmid, Albershausen (DE)

(73) Assignee: MICHAEL HOERAUF MASCHINENFABRIK GMBH, Donzdorf (DE)

( * ) Notice: Subject to any disclaimer, the term of this patent is extended or adjusted under 35 U.S.C. 154(b) by 535 days.

(21) Appl. No.: 14/732,100

(22) Filed: Jun. 5, 2015

(65) Prior Publication Data

US 2015/0352800 A1 Dec. 10, 2015

(30) Foreign Application Priority Data

Jun. 6, 2014 (DE) ..... 10 2014 210 961

(51) Int. Cl.
*B31D 5/00* (2017.01)
*B31B 50/44* (2017.01)
*B31B 105/00* (2017.01)
(Continued)

(52) U.S. Cl.
CPC ..... *B31D 5/0086* (2013.01); *B31B 50/44* (2017.08); *B31B 2105/00* (2017.08); *B31B 2110/10* (2017.08); *B31B 2110/20* (2017.08)

(58) Field of Classification Search
CPC ..... B31D 5/0086; B31B 2110/10; B31B 2110/20; B31B 50/44; B31B 2105/00
(Continued)

(56) References Cited

U.S. PATENT DOCUMENTS 2,169,345 A * 8/1939 Kuchler ..... B31B 50/00 229/4.5
2,216,331 A 10/1940 Swallow et al.
(Continued)

FOREIGN PATENT DOCUMENTS

CN 101331017 A 12/2008
JP S58-163641 A 9/1983
JP 2003-231191 A 8/2003

OTHER PUBLICATIONS

European Patent Office Search Report issued in Application No, EP 15 16 8688 with English translation of category of cited documents dated Nov. 18, 2015 (6 pages).
(Continued)

*Primary Examiner* — Hemant M Desai
*Assistant Examiner* — Tanzim Imam
(74) *Attorney, Agent, or Firm* — Flynn Thiel, P.C.

(57) ABSTRACT

Method for manufacturing a cup from a conical sleeve and a pot-shaped base. The base has a base face and a circumferential wall starting from the base face and inserted from a large opening in the conical sleeve into the sleeve in the direction of a small opening in the sleeve. The method includes: partially covering a radially outer circumferential face of the wall of the pot-shaped base with an annular covering sleeve, positioning the covering sleeve together with the base in the direction of the small opening in the sleeve until the predefined relative position between the sleeve and the base is reached, pulling out the covering sleeve between an inner side of the sleeve and the radially outer circumferential face of the base, the base remaining in the predefined relative position, and connecting the radially outer circumferential face of the base and the inner side of the sleeve in an essentially fluid-tight manner.

4 Claims, 6 Drawing Sheets

(51) Int. Cl.
*B31B 110/10* (2017.01)
*B31B 110/20* (2017.01)

(58) Field of Classification Search
USPC ..... 493/109, 108, 75, 84, 102, 297, 374, 493/152–155
See application file for complete search history.

(56) References Cited

U.S. PATENT DOCUMENTS 3,063,347 A * 11/1962 Cummings ..... B31C 7/02 493/106
3,157,339 A * 11/1964 Negoro ..... B65D 3/14 229/5.5
3,342,113 A * 9/1967 Baumgartner ..... B31B 50/00 493/106
3,602,690 A * 8/1971 Rosenberg ..... F24H 3/0405 156/497
3,673,033 A * 6/1972 MacDaniel et al. .... B29C 53/42 156/217
4,100,842 A 7/1978 Richards et al.
4,409,045 A * 10/1983 Busse ..... B29C 65/02 156/446
5,507,640 A 4/1996 Gilmer et al.
8,393,886 B2 3/2013 D'Amato
2014/0366490 A1* 12/2014 Saito ..... B31F 1/0093 53/452

OTHER PUBLICATIONS

First Office Action issued in Chinese Appln. No. 201510302206.4 dated Apr. 11, 2018 with English translation (16 pages).

* cited by examiner 18
16
IV 40
36
32
12
14
12
36
32
24
14

12
VIII
32
54
57
62
57

55
56
58
60
61
56
55
57
56

60

12
XII 58
62

METHOD AND DEVICE FOR MANUFACTURING A CUP

CROSS-REFERENCE TO RELATED APPLICATIONS

This application claims the priority of the German patent application DE 10 2014 210 961.2, filed Jun. 6, 2014, the disclosure of which is hereby incorporated into this application.

FIELD, BACKGROUND AND SUMMARY OF THE INVENTION

The invention relates to a method for manufacturing a cup from a conical sleeve and a pot-shaped base, wherein the base has a base face and a circumferential wall starting from the base face, and is inserted from a relatively large opening in the conical sleeve into the sleeve in the direction of the relatively small opening in the sleeve. The invention also relates to a device for manufacturing a cup from a conical sleeve and a pot-shaped base, wherein the device is designed to insert the base from a relatively large opening in the conical sleeve into the sleeve in the direction of the relatively small opening in the sleeve.

In known methods for manufacturing a cup and in known devices, problems can occur when inserting the pot-shaped base into the conical sleeve if during the insertion the base sticks against the inner side of the sleeve and as a result impedes correct positioning of the base in the sleeve. This can occur, for example, if the base and/or the sleeve are already coated with adhesive, if, for example, the material of the base and/or of the sleeve is sticky also merely owing to the ambient temperatures, or there is a high coefficient of friction at least between the base and the sleeve. It is problematic here that owing to the conical sleeve and the subsequent fluid-tight pressing of the base and sleeve, the base has to be placed in a position inside the sleeve in which it inevitably bears against an inner wall of the sleeve. Otherwise, it is not possible to press the base against the sleeve.

The invention is intended to improve a method and a device for manufacturing a cup from a conical sleeve and a pot-shaped base.

According to the invention, there is provision for at least partially covering a radially outer circumferential face of the wall of the pot-shaped base with an annular covering sleeve, arranging the covering sleeve and the base in a predefined relative position between the sleeve and the base, pulling out the covering sleeve between an inner side of the sleeve and the radially outer circumferential face of the base, wherein the base remains in the predefined relative position, and connecting the radially outer circumferential face of the base and the inner side of the sleeve in an essentially fluid-tight manner. According to the invention, an annular covering sleeve is therefore arranged between a radially outer circumferential face of the wall of the pot-shaped base and the inner side of the sleeve. Therefore, when the base is placed in position only the outer side of the covering sleeve comes into contact with the inner side of the sleeve. The outer side of the covering sleeve can be selected here with respect to the material or the surface in such a way that the covering sleeve can slide in an easily moving fashion on the inner side of the sleeve. The covering sleeve is not pulled out between the circumferential wall and the inner side of the sleeve until the base has reached a predefined relative position with respect to the sleeve. At this point, the base and the sleeve are located relative to one another but already at rest and at the predefined relative position. Possible sticking of the base and sleeve in this position is therefore undamaging and even desired during the subsequent step of fluid-tight connection. The invention therefore achieves in a surprisingly simple way a considerable improvement in a method for manufacturing a cup. Within the scope of the invention, the covering sleeve can be placed together with the base into the sleeve or the covering sleeve can be stationary in relation to the sleeve and the base can be pushed into the covering sleeve. The method according to the invention has particular advantages if owing to the materials of the base and sleeve there is a risk of the base sticking against the sleeve during a relative movement with respect to one another. The invention is therefore particularly designed for materials whose surfaces have a high coefficient of friction with respect to one another. This material can be, for example, coated paper material or coated pulp, for example but can also be a planar plastic material which can be processed in a similar manner to paper. Planar plastic materials are, for example, also plastic laminates. The invention is very well suited here for plastic material which can be processed in a similar manner to paper, but is not specifically designed for plastic material which can be processed in a similar manner to paper.

In a development of the invention, the predefined relative position corresponds, at least when viewed in the longitudinal direction of the sleeve, to the relative position of the base and sleeve on the finished cup.

In this way, the base and sleeve no longer have to be moved relative to one another after the covering sleeve has been pulled out between the circumferential wall of the base and the inner side of the sleeve. Slight sliding during the fluid-tight connection of the base and sleeve are accepted from this.

In one development of the invention, in the predefined relative position an outer circumferential face of the covering sleeve bears at least in certain sections against the inner side of the sleeve or is arranged directly adjacent to the inner side of the sleeve.

In this way, the circumferential wall of the base and the inner side of the sleeve can be moved very close to one another without being directly in contact. For example, the base can be arranged with slight prestress in the covering sleeve, with the result that after the pulling out of the covering sleeve the circumferential wall widens slightly and then the circumferential wall of the base bears in a planar fashion against the inner side of the sleeve.

In one development of the invention, there is provision for the covering sleeve to be positioned together with the base in the direction of the relatively small opening in the sleeve until the predefined relative position is reached.

According to the invention, the device for manufacturing a cup from a conical sleeve and a pot-shaped base is designed to insert the base from a relatively large opening in the conical sleeve into the sleeve in the direction of the relatively small opening in the sleeve. The device has an annular covering sleeve whose inner circumference is so large that a circumferential wall of the pot-shaped base bears against the inner circumference. Furthermore, the device has an apparatus for moving the covering sleeve in and counter to a longitudinal direction of the sleeve and an apparatus for securing the base in a predefined relative position with respect to the sleeve when simultaneously pulling out the covering sleeve between the inner side of the sleeve and the circumferential wall of the base. With the device according to the invention, the manufacture of a cup from a conical sleeve and a pot-shaped base is considerably facilitated, in particular when the materials or the surfaces of the base and sleeve have a high coefficient of friction with respect to one another and therefore there is a risk of the base sticking on the sleeve during a relative movement. This can occur, for example, with paper material which is coated in a fluid-tight fashion or also with plastic materials which are to be processed in a similar manner to paper.

In one development of the invention, a die for securing the base is provided, wherein the die has an activation rod and a die face which bears against the base, the covering sleeve being arranged in such a way that it can be slid on the activation rod of the die.

In this way, the covering sleeve can, for example, be arranged precisely concentrically with respect to the activation rod and also reliably guided during the pulling out of the covering sleeve between an inner side of the sleeve and the radially outer circumferential face of the base. The device according to the invention can as a result achieve high speeds and therefore short cycle times during the manufacture of cups.

BRIEF DESCRIPTION OF THE DRAWINGS

Further features and advantages of the invention can be found in the claims and the following description of preferred embodiments of the invention in conjunction with the drawings. Individual features of the different embodiments can be combined with one another in any desired way here without exceeding the scope of the invention. In the drawings:

DETAILED DESCRIPTION

Figure 1:
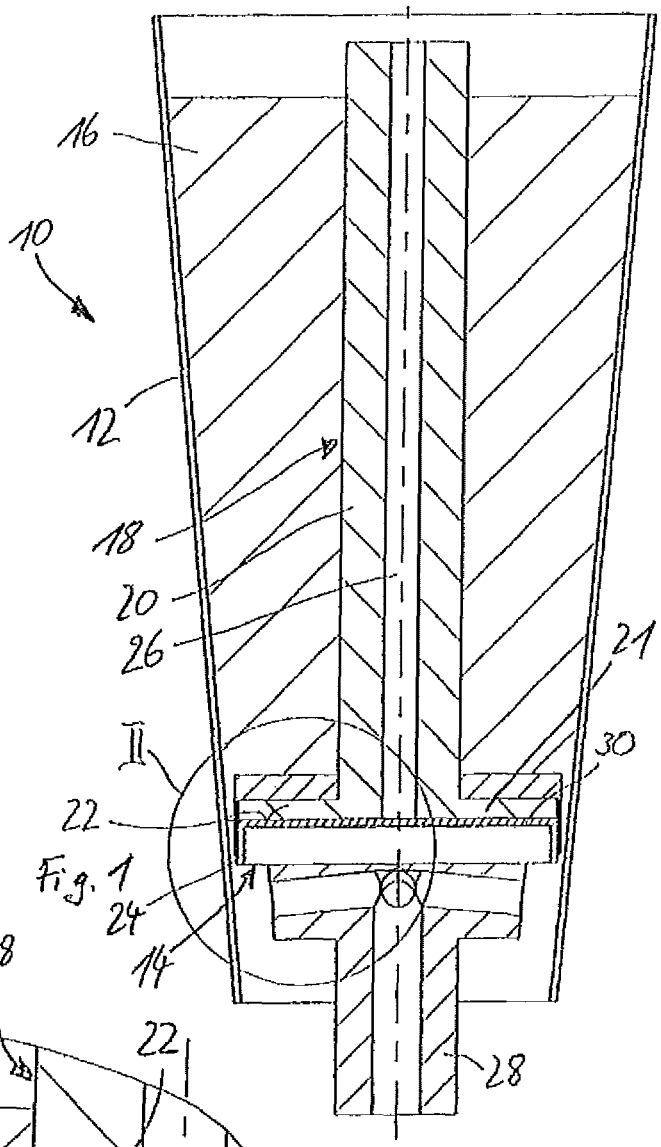
FIG. 1 shows a schematic sectional view through a device for manufacturing a cup in a first state.

FIG. 1 shows a schematic sectional view through a device 10 for manufacturing a cup from a conical sleeve 12 and a pot-shaped base 14. The device 10 can be part of a relatively large machine (not illustrated), and for example a plurality of the devices 10 can be arranged on a star wheel.

The sleeve 12 has been manufactured by winding and bonding or sealing in the region of an overlap (not illustrated) composed of a planar segment. The pot-shaped base has also been manufactured from a planar segment. The sleeve 12 is arranged on a mandrel 16 which is also conical and which has a central guide bore in which a die 18 for securing the base 14 is guided. The die 18 has an activation rod 20 and a die plate 21 with a die face 22. The die face 22 bears against a base face 30, in an upper position in FIG. 1, of the base 14. This upper base face 30 of the base 14 defines, on the finished cup, a lower boundary of the interior of the cup which is to be filled with fluid. A circumferential wall 24 starts from the base face of the base 14 and extends at a right angle to the base face. This gives the base 14 a pot-like shape.

The activation rod 20 is provided with a continuous bore 26. An underpressure is temporarily applied to the bore 26 during the production process. The through-bore 26 opens in the die face 22, with the result that after an underpressure has been applied to the bore 26 the base face of the base 14 is pulled against the die face 22. The base 14 can as a result be inserted securely into the sleeve 12, without the risk of it dropping away from the die face 22.

In the illustration in FIG. 1, the base 14 is inserted from above into the sleeve 12, that is to say in the direction of the relatively small opening in the sleeve 12.

An air outlet 28 is arranged underneath the base 14, which air outlet 28 is provided to blow warm air against the inner side of the sleeve in order to facilitate the deformation of the sleeve and specifically the folding over of the lower end of the sleeve 12 around the circumferential wall of the base 14. Warm air 29 flows radially out of the blower part 28 in order to heat the inner side of the sleeve 12 in a region, subsequent to which the circumferential wall 24 of the base 14 comes to rest. For example, a seal-like coating of the inner side of the sleeve 12 can be heated in order then to permit the circumferential wall 24 to be sealed, therefore permitting a fluid-tight connection of the circumferential wall 24 and sleeve 12.

Figure 2:
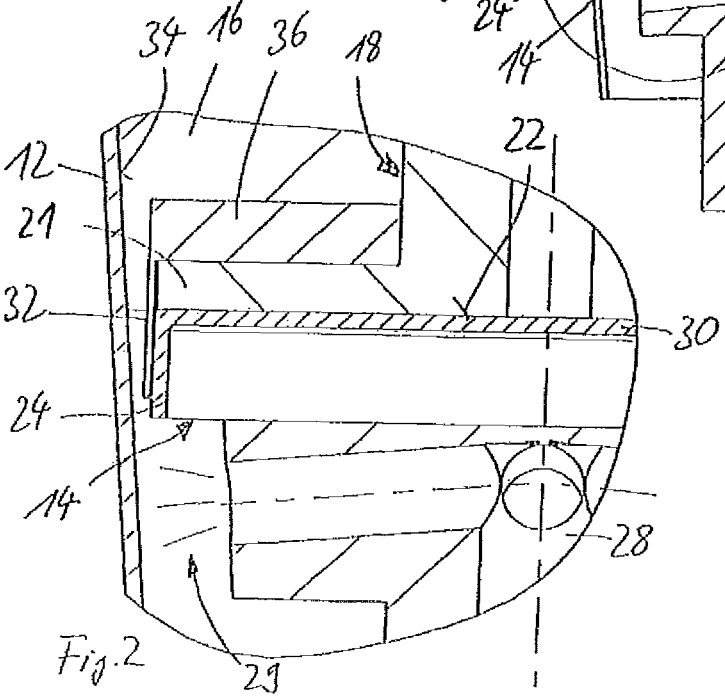
FIG. 2 shows the enlarged detail I from FIG. 1.

The enlarged detail II in FIG. 2 firstly shows the die face 22 against which the base face 30 of the base 14 is sucked. An outer side of the circumferential wall 24 of the base 14 is covered in certain sections by an annular covering sleeve 32. The covering sleeve 32 bears against a radially outer circumferential face of the circumferential wall 24 of the base 14. As will be explained below, the covering sleeve prevents the radially outer face of the circumferential wall 24 from coming into contact with an inner side 34 of the sleeve 12 before a predefined relative position of the base 14 and sleeve 12 is reached.

The annular covering sleeve 32 is provided with a circular attachment plate 36, the central bore of which is matched to the outer diameter of the activation rod 20. The attachment plate 36 and the annular covering sleeve 32 which is connected in one piece to the attachment plate 36 can therefore be slid relative to the die 18. In the state in FIG. 1 and FIG. 2, an underside of the attachment plate 36 bears on an upper side of the die plate 21. The attachment plate 36 bears with its upper side on a face of the mandrel 16.

Starting from the state in FIG. 1 or FIG. 2 the die 18 is moved downwards together with the base 14 and the sleeve 32.

Figures 3, 4:
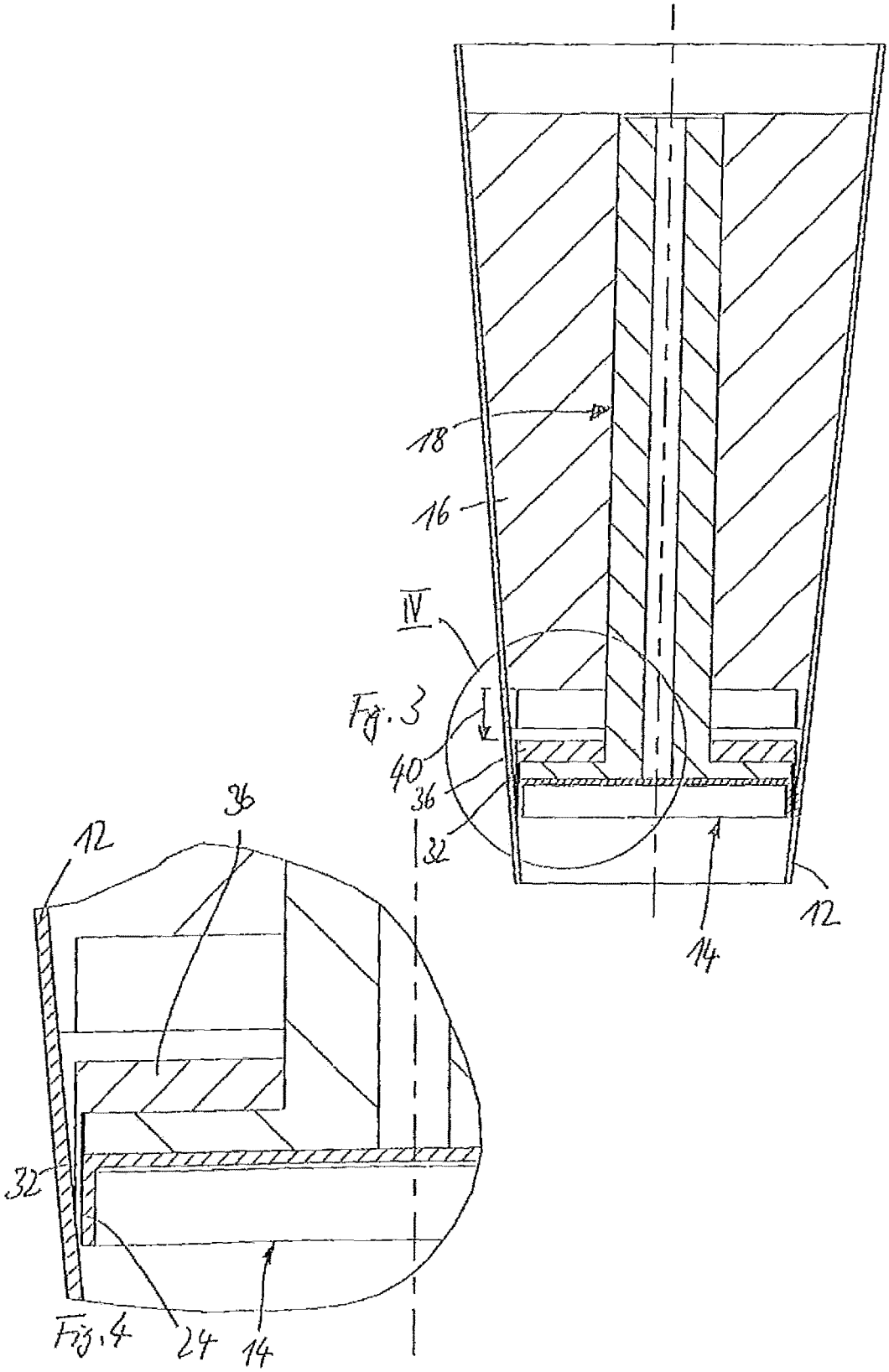
FIG. 3 shows a schematic sectional view through the device in FIG. 1 in a second state.
FIG. 4 shows the detail IV in FIG. 3 in an enlarged illustration.

This state is then illustrated in FIG. 3. In the state in FIG. 3, the base 14 and the sleeve 12 have reached a relative position with respect to one another which they also assume with respect to one another on the finished cup. In other words, in order to finish the cup the base 14 no longer has to be moved relative to the sleeve 12, at least not in the longitudinal direction of the sleeve 12.

It is apparent in FIG. 3 that starting from the state in FIG. 1 and FIG. 2 the die 18 has been moved downwards by the distance, which is indicated by the arrow 40 in FIG. 3. This is because the upper side of the attachment plate 36, which is connected in one piece to the annular covering sleeve 32, is then arranged at a distance from the mandrel 16. For this purpose, the activation rod 20 was slid inside the guide bore in the mandrel 16, as is also apparent, for example, with reference to the upper end of the activation rod 20, see FIG. 1 and FIG. 3.

The enlarged detail IV from FIG. 3 is illustrated in FIG. 4 and makes it apparent that the annular covering sleeve 32 then bears on one side on the inner side of the sleeve 12 and on the other side on the radially outer circumferential face of the circumferential wall 24 of the base 14. The inner diameter of the covering sleeve 32 can be dimensioned in such a way that the base 14 is slightly compressed, and therefore springs back slightly after the pulling out of the covering sleeve 32, with the result that the circumferential wall 24 then bears essentially in a planar fashion against the inner side of the sleeve 12. The circumferential wall 24 of the base 14 does not bear against the inner side of the sleeve 12, even though the base 14 and the sleeve 12 are arranged in a relative position with respect to one another which they also assume with respect to one another on the finished cup.

Figures 5, 6:
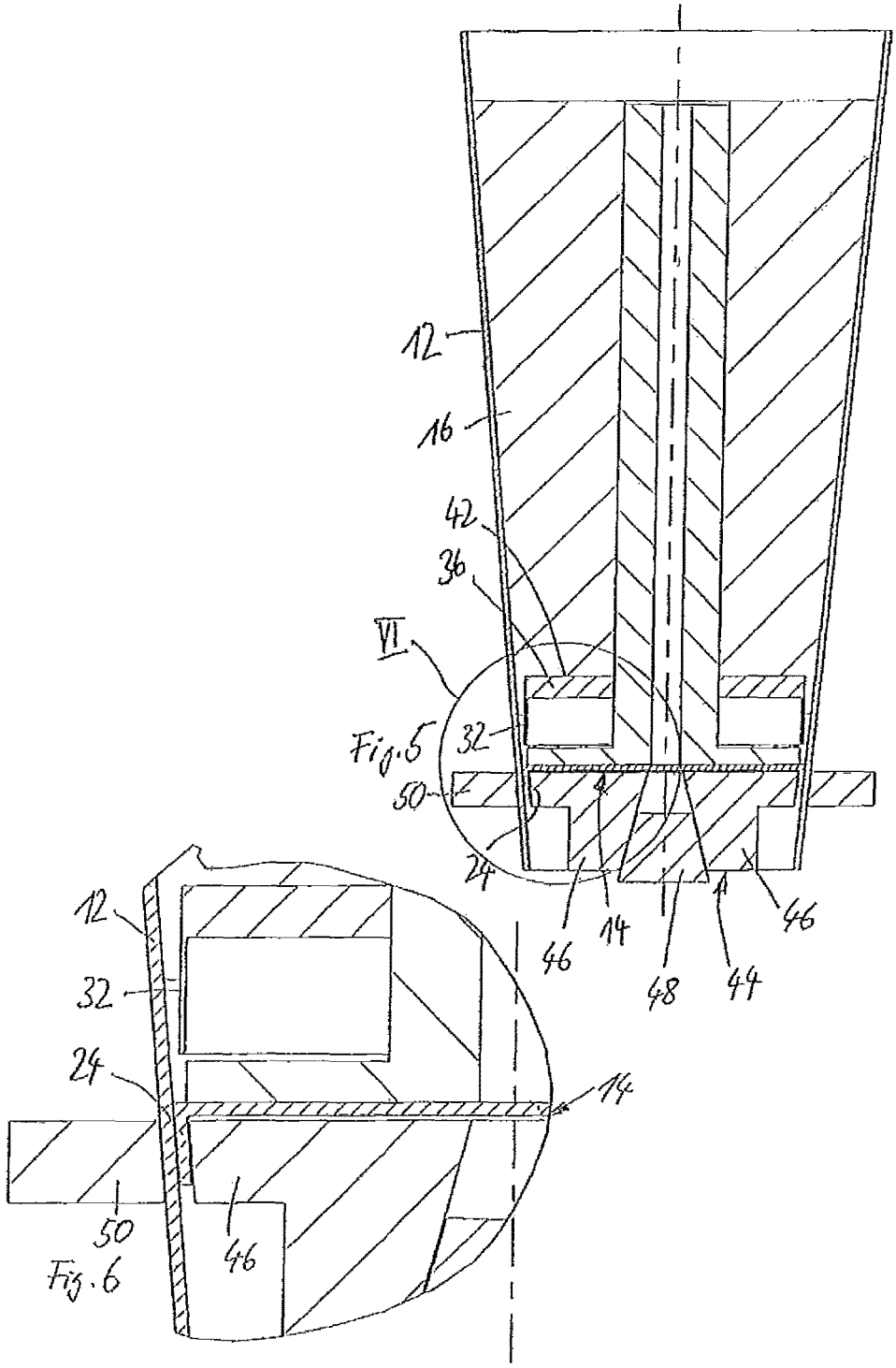
FIG. 5 shows a schematic sectional view through the device in FIG. 1 in a third state.
FIG. 6 shows the detail VI in FIG. 5 in an enlarged illustration.

Starting from the state in FIG. 3 and FIG. 4, the covering sleeve 32 is then pulled out upwards, together with the attachment plate 36, between the inner side of the sleeve and the circumferential wall 24 of the base 14. This pulled-out state is illustrated in FIG. 5. It is apparent that the attachment plate 36 now bears again against the stop face 42 on the mandrel 16. The covering sleeve 32 has then been completely pulled out between the base 14 and the sleeve 12, and the circumferential wall 24 bears against the inner side of the sleeve 12. A multi-part die 44 has then been inserted from below into the sleeve 12. This die 44 has a plurality of pressing jaws 46 which can be moved in the radial direction and which can be pressed radially outwards by a centrally arranged activation element 48. A securing ring 50 bears on an outer side of the sleeve 12 in the region of the circumferential wall 24 of the base 14. This securing ring 50 provides a counter-bearing when the pressing jaws 46 are moved radially outwards in order to press the circumferential wall 24 against the inner side of the sleeve 12.

It is essential that in order to press the circumferential wall 24 and the inner side of the sleeve 12, which is performed starting from the state in FIG. 5, there is no longer any need for relative sliding between the base 14 and the sleeve 12. Therefore, there is no risk that frictional forces between a surface of the base 14 and a face of the sleeve 12 have to be overcome in order to position the base 14 in the sleeve 12.

The illustration in FIG. 6 shows the detail VI in FIG. 5 in an enlarged illustration. As has already been explained, the circumferential wall 24 of the base 14 now bears in a planar fashion against the inner side of the sleeve 12, since the annular covering sleeve 32 has been pulled out upwards between the circumferential wall 24 and the inner side of the sleeve 12. The pressing jaws 46 and the securing ring 50 then ensure that the circumferential wall 24 is pressed with the inner side of the sleeve 12 and as a result ensure fluid-tight connection of the base 14 to the sleeve 12.

Figures 7, 8:
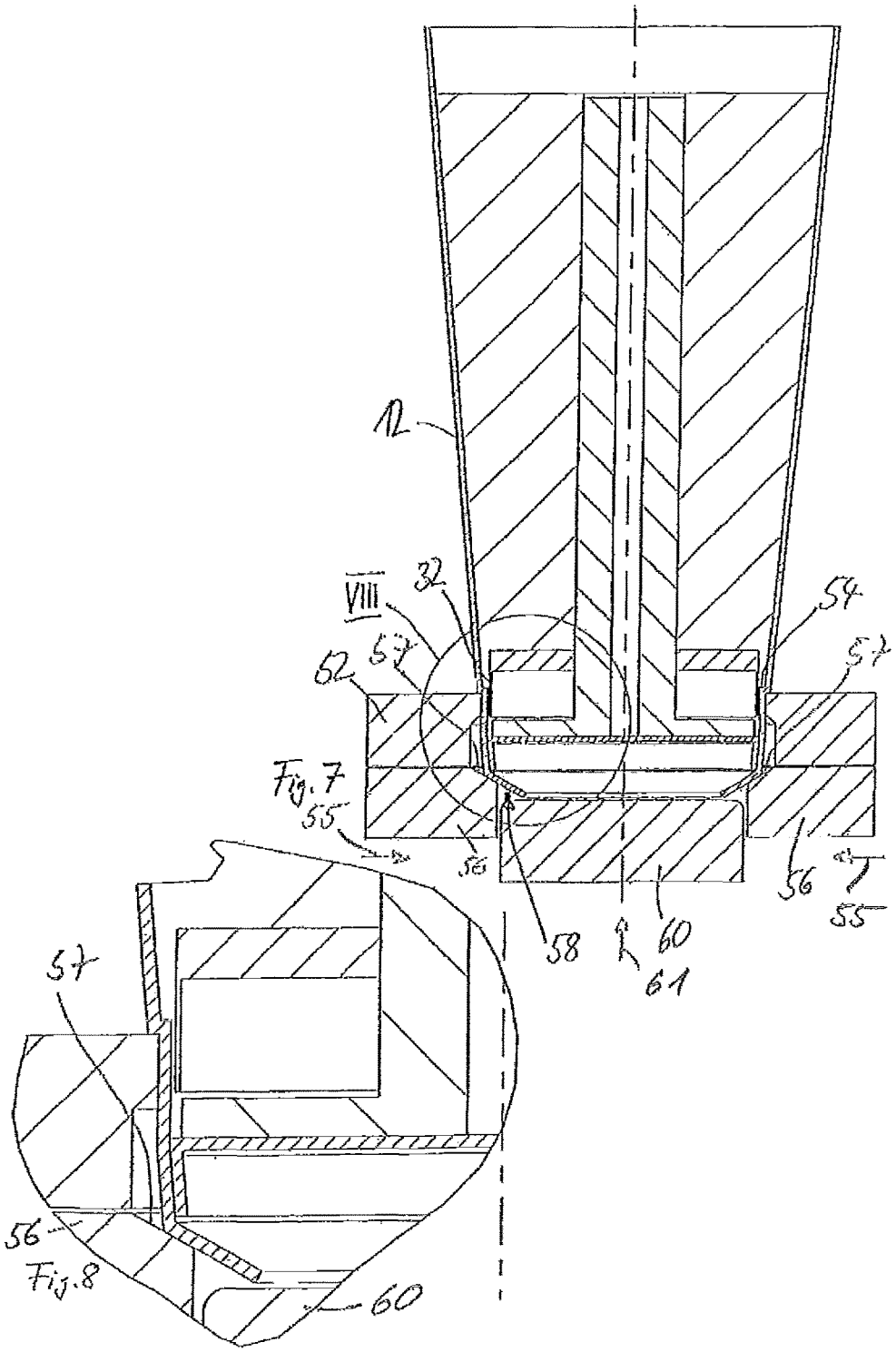
FIG. 7 shows a schematic sectional view through the device in FIG. 1 in a fourth state.
FIG. 8 shows the enlarged detail VIII from FIG. 7.

The illustration in FIG. 7 shows a further method step which follows the state in FIGS. 5 and 6. The pressing jaws 46 and the securing ring 50 have been removed. A circumferential stacking shoulder 54 is now introduced into the sleeve 12 by means of a pressing ring 52, which in FIG. 7 is then pushed onto the sleeve 12 from below. The stacking shoulder serves to be able to reliably stack a plurality of cups one in the other. During the fitting on of the pressing ring 52, the annular covering sleeve 32 provides a certain degree of counter-pressure, said covering sleeve 32 being arranged radially inside the pressing ring 52 in the state in FIG. 7. A plurality of jaws 56 which can be slid radially inwards according to the arrows 55 ensure that the lower edge 58 of the sleeve is folded over radially towards the inside. The jaws 56 are illustrated in their radially inner end position in FIG. 7 and FIG. 8. A radially inner edge of the jaw 56, which brings about the folding over of the lower edge 38 of the sleeve 12, is provided with a bevel 57 which runs up onto the lower edge 38 of the sleeve during a movement of the jaws 56 according to the arrows 55 and folds over the edge 38 inwards by approximately 50° to 60°. Since all the jaws 56 have a bevel 57, the edge 38 is folded over inwards over its entire circumference. A further folding over of the edge 38 by approximately 180° then is brought about by a die 60 which is slid upwards starting from the state in FIG. 7 according to the arrow 61. The folding over of the lower edge of the sleeve is facilitated, since the sleeve 12 has previously been heated in this folding-over region, see FIG. 2.

The illustration in FIG. 8 shows the detail VIII in FIG. 7 in an enlarged illustration.

Starting from the state in FIG. 7, the lower edge 58 of the sleeve 12 is folded over by approximately 180° by means of the die 60, as has already been explained.

Figure 9:
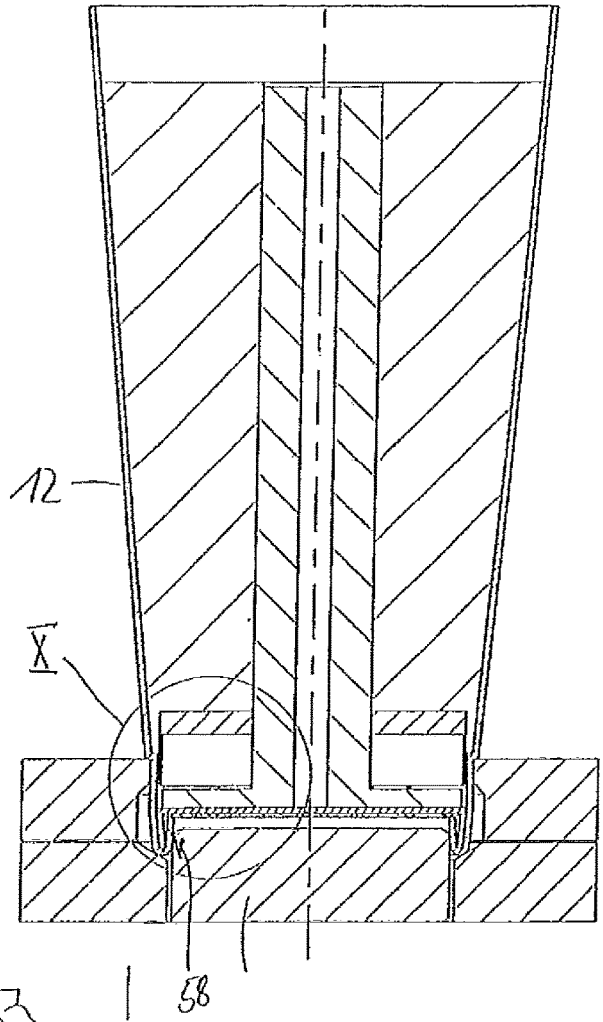
FIG. 9 shows the device in FIG. 1 in a fifth state.
Figure 10:
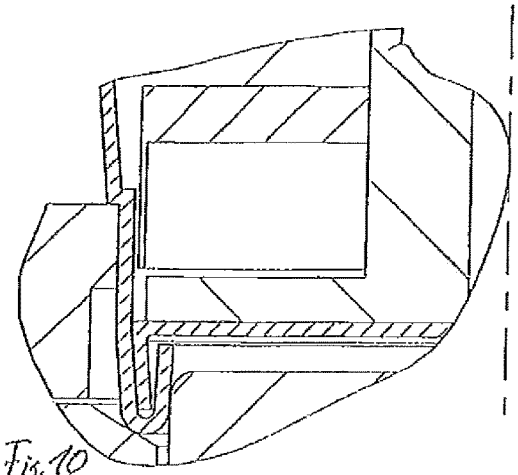
FIG. 10 shows the detail X in FIG. 9 in an enlarged illustration.

FIG. 10 shows the detail X in FIG. 9 in an enlarged illustration.

Figure 11:
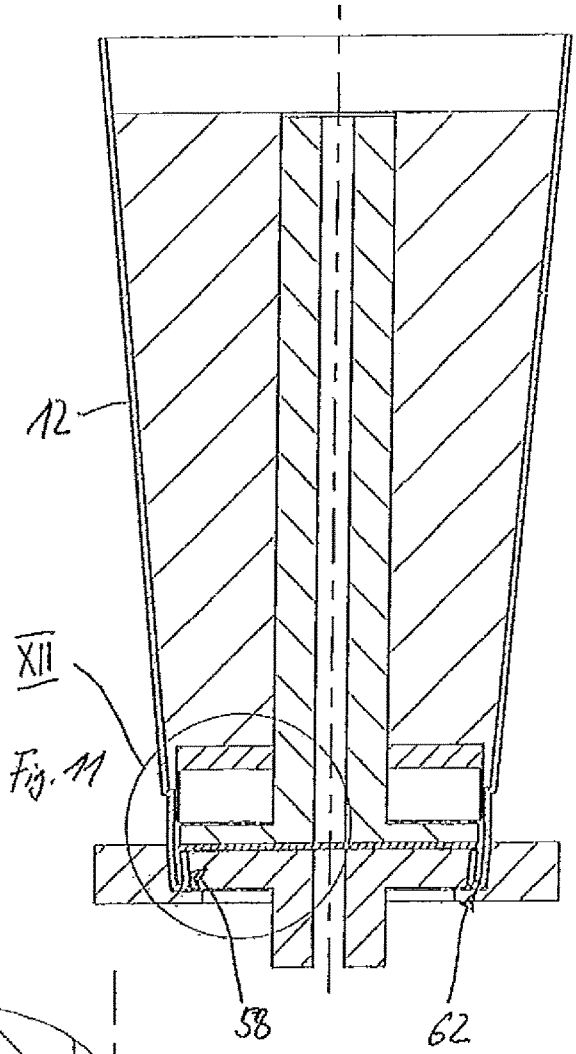
FIG. 11 shows the device in FIG. 1 in a sixth state.

As is apparent in FIG. 11, starting from the state in FIG. 9 the lower edge 58 of the sleeve 12 is then pressed radially outwards in order to form what is referred to as a circumferential rim 62 at the lower end of the sleeve 12. The rim 62 then forms the standing face for a finished cup.

Figure 12:
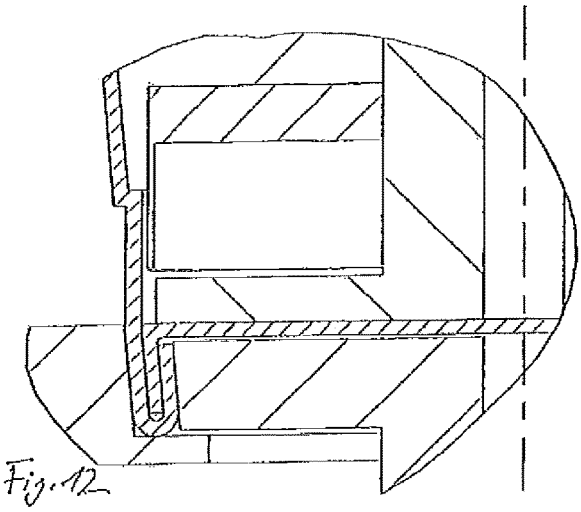
FIG. 12 shows the detail XII from FIG. 11 in an enlarged illustration.

The illustration in FIG. 12 shows the enlarged detail XII from FIG. 11.

As is apparent in particular with reference to FIGS. 3 to 6, the annular covering sleeve permits the base and the sleeve 12 to be positioned relative to one another in such a way that they have already reached the relative position provided on the finished cup, without the base 14 and the inner side of the sleeve 12 touching. In particular, the radially outer face of the circumferential wall 24 of the base and the inner side of the sleeve 12 do not touch one another, see FIG. 4, until the predefined relative position is reached. A possible high coefficient of friction between the material or the surface of the base 14 and the inner side of the sleeve 12 therefore does not impede the manufacturing process of the cup. After the annular covering sleeve 32 between the inner side of the sleeve 12 and the base 14 has been pulled out, the circumferential wall 24 of the base 14 can bear with its radially outer face in a planar fashion against the inner side of the sleeve 12. Since the inner side of the sleeve 12 has previously been heated in this region, the base 14 and sleeve 12 can be connected in a fluid-tight fashion immediately. This is assisted by the radially outwardly moving pressing jaws 46.

The invention claimed is:

1. A method for manufacturing a cup, the method comprising:

providing a conical sleeve and a pot-shaped base, the pot-shaped base having a base face and a circumferential wall which depends from the base face, the conical sleeve having a first end with a first opening and a second end with a second opening, the second opening being smaller than the first opening, the conical sleeve having a longitudinal axis passing through a first center of the first opening and a second center of the second opening;

inserting the pot-shaped base into the conical sleeve from the first end and through the first opening in a direction toward the second end of the conical sleeve;

at least partially covering a radially outer circumferential face of the circumferential wall of the pot-shaped base with an annular covering sleeve;

positioning the annular covering sleeve between the pot-shaped base and the conical sleeve;

maintaining the pot-shaped base at a connecting position along the longitudinal axis of the conical sleeve such that the pot-shaped base does not move relative to the conical sleeve along the longitudinal axis of the conical sleeve while in the connecting position, with the annular covering sleeve being initially between the pot-shaped base and the conical sleeve while the pot-shaped base is in the connecting position;

after the step of maintaining the pot-shaped base at the connecting position with the annular covering sleeve being initially between the pot-shaped base and the conical sleeve, removing the annular covering sleeve from between the conical sleeve and the pot-shaped base, with the pot-shaped base remaining at the connecting position during the step of removing the annular covering sleeve; and connecting the radially outer circumferential face of the circumferential wall of the pot-shaped base and an inner side of the conical sleeve in a fluid-tight manner, wherein, during the step of connecting, the pot-shaped base remains in the connecting position.

2. The method according to claim 1, wherein the connecting position corresponds, at least when viewed along the longitudinal axis of the conical sleeve, to a relative position of the pot-shaped base with respect to the conical sleeve on the cup.

3. The method according to claim 1, further including moving the annular covering sleeve together with the pot-shaped base in a direction of the second opening in the conical sleeve until the connecting position is reached.

4. The method according to claim 1, wherein, in the connecting position, at least a portion of an outer circumferential face of the annular covering sleeve bears against the inner side of the conical sleeve or is arranged directly adjacent to the inner side of the conical sleeve.

* * * * *